United States Patent [19]

Furuya

[11] 4,014,773

[45] Mar. 29, 1977

[54] APPARATUS FOR ELECTROLYTIC TREATMENT

[75] Inventor: Kiyoto Furuya, Yokohama, Japan

[73] Assignee: Daiichi Denshi Kogyo Kabushiki Kaisha, Tokyo, Japan

[22] Filed: July 15, 1975

[21] Appl. No.: 596,184

[30] Foreign Application Priority Data

July 31, 1974 Japan ..... 86,911/74

[52] U.S. Cl. ..... 204/206; 204/15; 204/28; 204/224 R

[51] Int. Cl.[2] ..... C25D 17/00; C25D 17/06; C25D 7/06; C25D 5/02

[58] Field of Search ..... 204/15, 224 R, 206, 204/28, 207–211, 225, 275, DIG. 7

[56] References Cited

UNITED STATES PATENTS

| | | | |
|---|---|---|---|
| 2,974,097 | 3/1961 | Ramirez et al. | 204/15 |
| 3,274,092 | 9/1966 | Marantz | 204/15 |
| 3,644,181 | 2/1972 | Donaldson | 204/15 |
| 3,723,283 | 3/1973 | Johnson et al. | 204/224 R |
| 3,745,105 | 7/1973 | Kosowsky et al. | 204/224 R |
| 3,746,630 | 7/1973 | Kosowsky et al. | 204/224 R |
| 3,819,502 | 6/1974 | Meuldijk et al. | 204/224 R |

FOREIGN PATENTS OR APPLICATIONS

| | | | |
|---|---|---|---|
| 255,736 | 7/1926 | United Kingdom | 204/15 |
| 840,544 | 7/1960 | United Kingdom | 204/15 |
| 1,098,182 | 1/1968 | United Kingdom | 204/15 |

OTHER PUBLICATIONS

IBM Tech. Disclosure, vol. 7, No. 9, Feb. 1965, p. 734.

*Primary Examiner*—T. M. Tufariello
*Attorney, Agent, or Firm*—Silverman & Cass

[57] ABSTRACT

A method of electrolytic treating elongated materials such as hoop materials, rods and wires and an apparatus for carrying out the method comprising a treating unit consisting of unit halves comprising a through passage for feeding the material to be treated, insulating passages for flowing a treating liquid onto the surfaces of the material to be treated, electrodes for flowing electric current between the material and the electrodes and an insulating shield for shielding portions of the material not to be treated. When the material is fed continuously or intermittently through the treating unit while electric current flows between the electrodes and the material, the material is subjected to the electrolytic treatment or plating, of which plated portions are of desired size, shape and location on the material.

17 Claims, 44 Drawing Figures

APPARATUS FOR ELECTROLYTIC TREATMENT

BACKGROUND OF THE INVENTION

1. Field of the Invention

This invention relates to a method of electrolytic treatment such as plating and an apparatus for carrying out the method, particularly a method and apparatus suitable for electrolytic treatment, such as local plating and local electrolytic polishing of elongated materials such as hoop, wire and rod materials.

2. Description of the Prior Art

Heretofore, to obtain locally electrolytically treated or locally plated hoop materials, it has been widely used to stick insulating tapes or coat insulating paint to portions of the materials not to be treated and then to perform the electrolytic treatment. This method, however, requires an apparatus for sticking tapes to or coating with paint the portions not to be treated and troublesome and skill-requiring operations for the coating and removal of the tapes or coated paint.

Moreover, to obtain local plating it has been suggested that a material is brought in contact with rollers to perform plating only the portions of the material not in contact with the rollers or guided by means of a particular channel-like guide to perform plating of one side surface of the material, which forms sealing means with the contacted portions of the material for preventing the other side surface of the material from being in contact with a treating liquid. It has also been suggested that a material is brought into contact with outer surfaces of two spaced drums or is brought into contact with a treating liquid adhering to rollers, which are also anodes and partially immersed in the treating liquid, to perform plating of portions along the length of the material. It has further been suggested to perform a partial plating by the use of resilient packings tightly enclosing or accommodating a treating liquid.

These prior methods do not necessarily provide a satisfactory answer for the partial plating and have disadvantages in that it is very difficult to apply to a mass-production, to obtain uniform quality of treated materials and to vary in shape and location of partially plated portions of the material and apparatuses are generally bulky and expensive. In general, hitherto used apparatus including these above mentioned ones are apt to be large because of many rollers bending the material into treating liquid. When these rollers are operated, the transferred material may be subjected to a great force from the rollers resulting in deformation and breakage of the material and limitation of feeding speed of the material owing to the rollers will obstruct the speedup of the treatment. Apparatuses intended to avoid these disadvantages are further apt to be more bulky and expensive. If the rollers are small in diameter, there is a tendency of the rollers to severely act on the material to give a permanently residual deformation to the material and if the straightening of such a deformed material is difficult, sufficiently large rollers in diameter are must be used to avoid the residual deformation, which make a series of apparatus bulky.

Since the treating liquid is in a top opened bath, which includes noxious or powerful material for the treatment, this noxious liquid will evaporate and splash in a workroom, so that the environment in the room will grow worse to a dangerous condition for workmen.

It is accordingly a principal object of the invention to provide a method and an apparatus for electrolytic treatment such as plating which overcome the above disadvantages in the prior art.

It is another object of the invention to provide a method and an apparatus for electrolytic treatment such as plating capable of partially plating portions of desired shapes and sizes at any desired locations on materials at high speed with ease.

It is further object of the invention to provide a method and an apparatus for electrolytic treatment such as plating capable of performing a variety of partial platings of elongated materials in size, shape and location by changing minimum numbers of parts of the apparatus.

It is still further object of the invention to provide an apparatus for electrolytic treatment such as plating which is so compact that the apparatus can be enclosed by a cover as a whole and utilize any ventilating means to provide a sanitary atmosphere in a workshop.

The above and other related objects and features of the invention will be apparent from a reading of the following description of the disclosure found in the accompanying drawings.

DESCRIPTION OF THE PREFERRED EMBODIMENT

Figure 1:
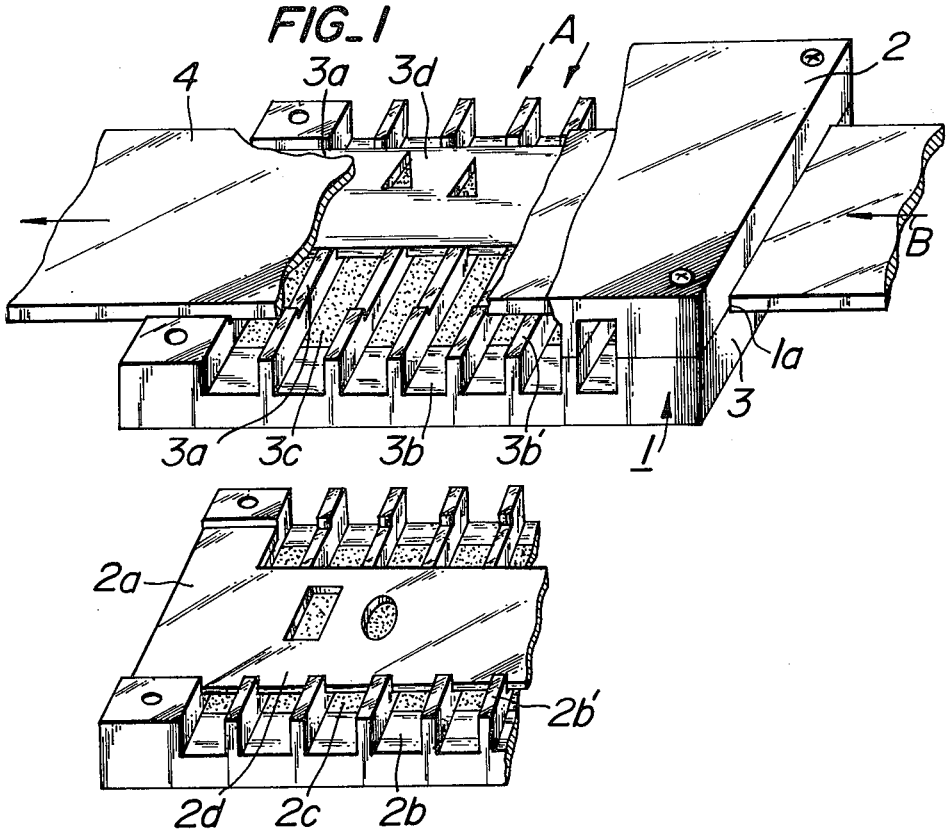
FIG. 1 is a perspective view of a preferred embodiment of an apparatus according to the invention.

Referring first to FIGS. 1–5, there is shown a treatment unit for carrying out the electrolytic treatment according to the invention. FIG. 1 is a partially exploded perspective view of the unit 1 consisting of first and second unit halves 2 and 3 for an electrolytic treatment such as plating of elongated plate-like materials or members, for example, hoop steel or strip materials. The first and second unit halves 2 and 3 are formed with respective flat cut portions 2*a* and 3*a* to form a through passage 1*a* for feeding and transferring the hoop materials for the purpose of preventing the materials from moving in a traverse direction and from being deformed by a pressure derived from electrolyte for the treatment in the unit. Insulating spacing partitions 2*b*′and 3*b*′of the first and second unit halves form passages 2*b* and 3*b* for the electrolyte and serve to prevent a contact between electrodes 2*c* and 3*c* and the materials to be treated and to keep steady the treating liquid or electrolyte. Insulating shields 2*d* and 3*d* shield the hoop materials from the electrodes 2*c* and 3*c* depending upon the configuration, size and location of portions of the material to be treated in order to prevent electric current and electrolyte from passing through the portion of the material not to be treated. The configuration and arrangement of the electrodes 2*c*, 3*c* and the shields 2*d*, 3*d* are alternatively selected according to the configuration of portions to be plated, such for example as shown in FIGS. 2*a*–2*h*, each of which denotes only one unit half wherein the same references as in FIG. 1 denote the like parts.

Figure 2A:
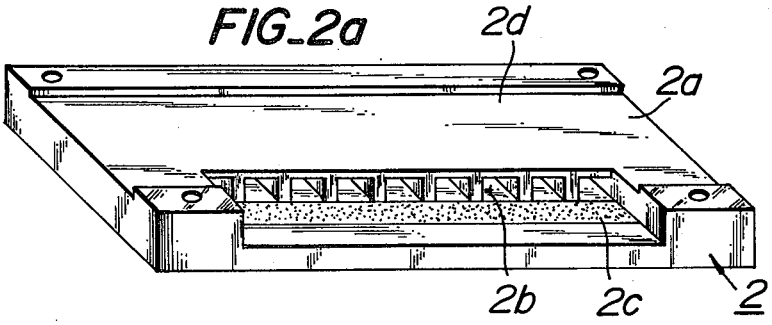
FIGS. 2*a*, 2*b*, 2*c*, 2*d*, 2*e*, 2*f*, 2*g* and 2*h* are perspective views showing unit halves of the apparatus according to the invention for performing various kinds of partial platings in size, shape and location on materials to be treated.
Figure 2B:
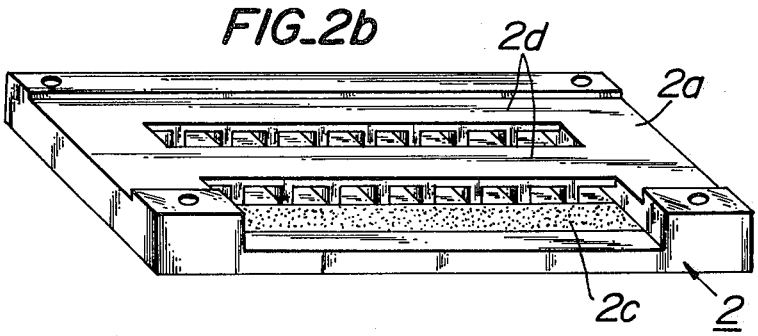
Figure 2C:
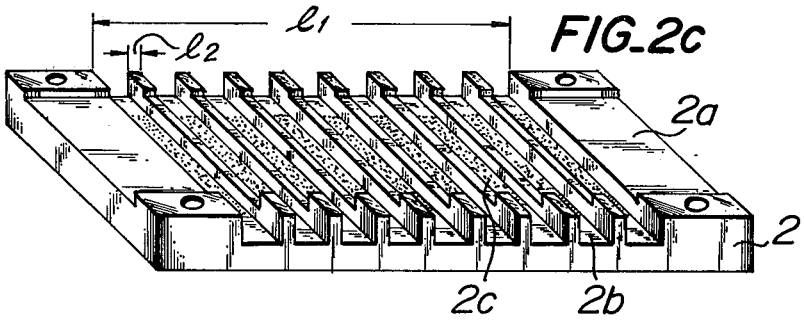
Figure 2F:
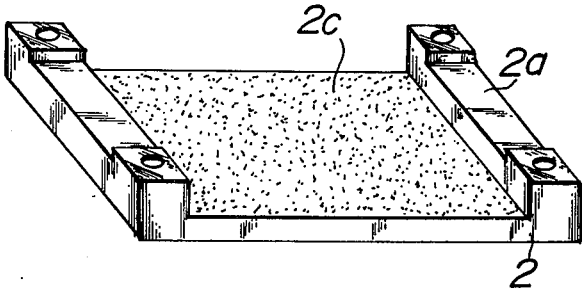
Figure 2G:
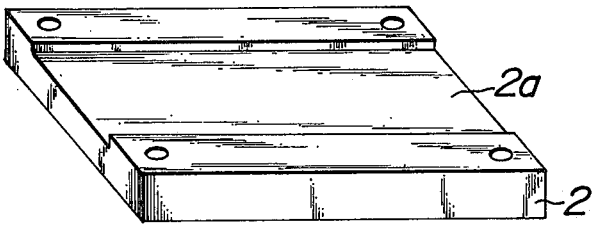
Figure 3A:
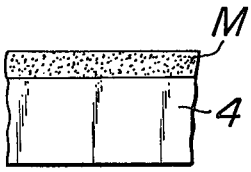
FIGS. 3*a*, 3*a'*,3*b*, 3*b'*, 3*b''*, 3*b'''*, *3c* 3*c'*, 3*d*, 3*d'*, 3*d''*, 3*e*, 3*f* and 3*f'* are diagrammatic illustrations of materials partially plated in various shapes, sizes and locations according to the invention.
Figure 3A:
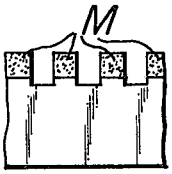
Figure 3B:
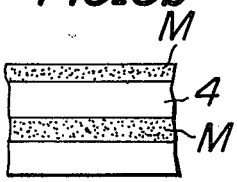
Figure 3B:
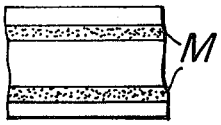
Figure 3B:
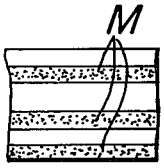
Figure 3B:
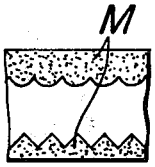
Figure 3C:
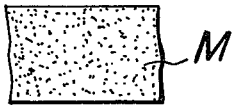
Figure 3C:
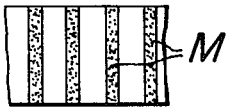
Figure 3D:
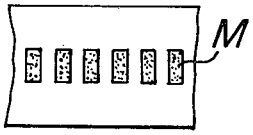
Figure 3E:
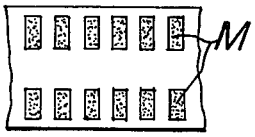
Figure 3E:
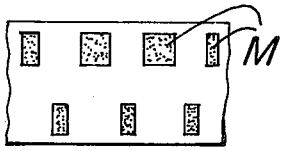
Figure 3D:
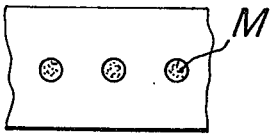
Figure 3D:
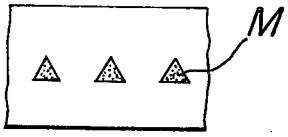
Figure 3F:
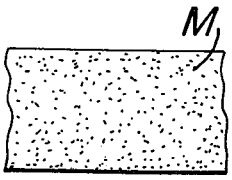
Figure 3F:
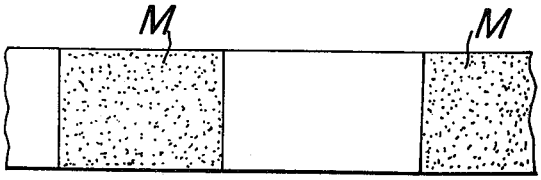

With such an arrangement of the treatment unit 1, the treating liquid or electrolyte is continuously caused to be passed through the passages 2*b*, 3*b* in the direction as shown in arrows A in FIG. 1 and voltage is applied between the hoop material 4 and the electrodes 2*c*, 3*c* so as to make current flow therebetween, while the hoop material is transferred in the direction as shown in arrows B to obtain a local or partial plating of the member as shown in dotted portions in FIGS. 3*a*–3*f*′. For example, as shown in FIG. 2*a* one ends of the passages 2*b*, 3*b* of the first and second unit halves for the electrolyte are communicated with each other over a certain length and the shields are cut away to an extent facing the communicated portions of the passages, within which are settled the electrodes 2*c*, 3*c* which have been made in size and configuration mating with the spaces. The unit constructed in this manner provides continuous plated layers M on both sides of one longitudinal edge of an elongated hoop material 4 as shown in FIG. 3*a* or a particularly shaped hoop material with teeth as shown in FIG. 3*a*′. Such electrodes may be provided in more than two portions as shown in FIG. 2*b* so that two or three continuous longitudinal plated portions are provided on the member as shown in FIGS. 3*b*–3*b*″. The shield plates may be so shaped that particular plated layers M are obtained as shown in FIG. 3*b*‴. As shown in FIG. 2*c*, electrodes may be arranged in all the passages 2*b*, 3*b* for the electrolyte. In this case, if the material is fed continuously plated layers will be applied to all over surfaces of the material as shown in FIG. 3*c*. If the material is fed intermittently, stripe layers at right angles to the longitudinal direction of the material are obtained as shown in FIG. 3*c*′, wherein a distance for one intermittent feeding is $l_1+l_2$ as shown in FIG. 2*c*. The shield plates 2*d*, 3*d* may be formed with rectangular or square through apertures 2*d*′, 3*d*′in opposition to the passages 2*b*, 3*b* for the electrolyte and the hoop material 4 is fed intermittently so that intermittent plated layers M are obtained on the material as shown in FIGS. 3*d* and 3*e*. The through apertures 2*d*′, 3*d*′may be arranged in various desired positions and varied in size and shape, for example, circular and triangular which will obtain particular shaped plated layers as shown in FIGS. 3*d*′, 3*d*″or 3*e*′. If the electrodes 2*c*, 3*c* extend all over the passages 2*b*, 3*b* for the electrolyte as shown in FIG. 2*f* and the hoop material is fed continuously or intermittently, entirely plated or intermittent plated layers M on the material as shown in FIGS. 3*f* and 3*f*′. As shown in FIG. 2*g*, one of the first and second unit halves 2 and 3, for example, the first unit half 2 may be provided only with the flat cut portion 2*a* but devoid of the other portions, such as the passageways for electrolyte and the electrodes, so that only one surface of the material is subjected to the electrolyte treatment or plating. The same result may be obtained by applying electric current only to the electrodes on one side.

In the above arrangement, though the electrodes are provided positionally corresponding to the portions of the material to be plated, electrodes may be provided all over the surfaces of the unit halves upon which are fixed insulating partitions to form passages for electrolyte and surfaces of the electrodes positionally corresponding to portions of the material not to be plated are covered in a desired shape by shield plates. Although in the above embodiment the shield plates are used to obtain the plated portions having desired shapes, sizes and locations on the material, the passages 2*b*, 3*b* for the electrolyte may be varied in shape and width in order to obtain the same purpose as shown in FIG. 2*h*. Though the through passage 1*a* for hoop material is arranged at right angles to the passages for electrolyte, it may be in parallel with the electrolyte passages.

Figure 2D:
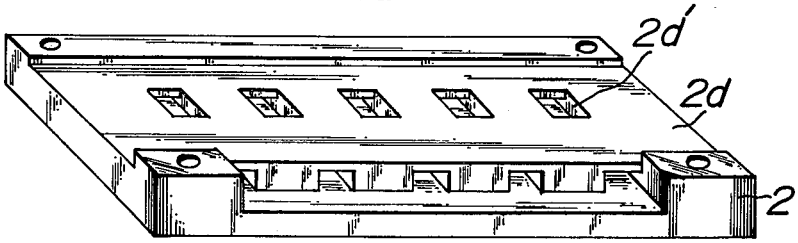
Figure 2E:
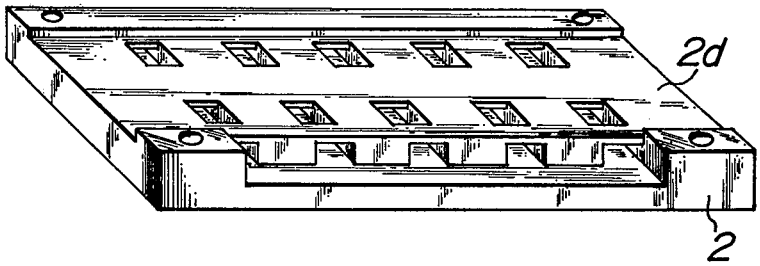
Figure 2H:
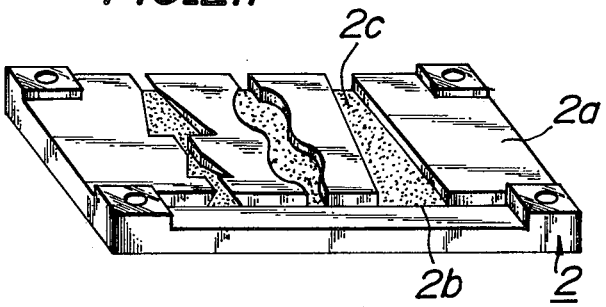

In order to obtain the intermittent plated portions as shown in FIGS. 3*c*′, 3*d* and 3*e*, the material must be transferred intermittently in the units as shown in FIGS. 2*c*, 2*d* and 2*e*. With an arrangement as shown in FIG. 4, however, the material may be fed continuously to obtain the intermittent plates portions which will be explained in detail.

Figure 4:
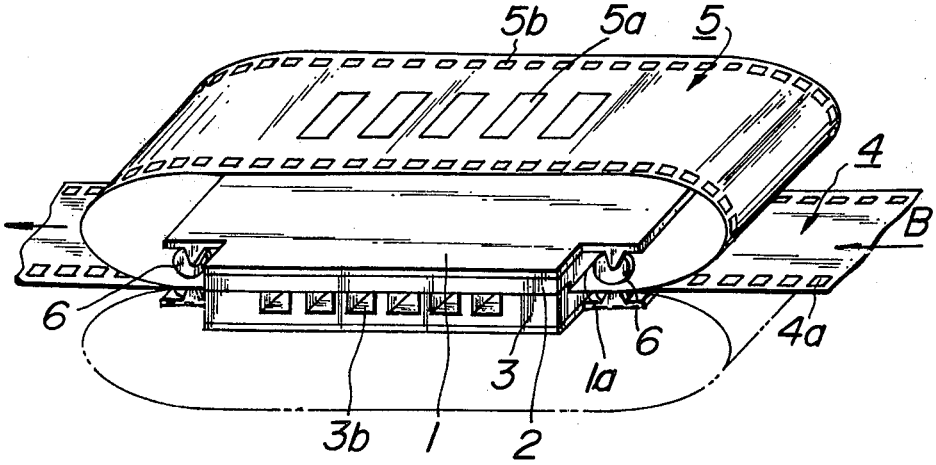
FIG. 4 is a perspective view of a preferred embodiment of an apparatus according to the invention using an endless shield instead of a straight shield.

Referring to FIG. 4, a unit 1 comprises an endless shield tape 5 of which lower half is received together with a hoop material 4 within the through passage 1*a*. The shield tape 5 is formed with apertures 5*a* for local plating of the material 4 and along each edge of the shield tape with a series of apertures 5*b* for driving thereof. Shield tape feeding gears or sprockets 6 are provided on the unit 1, of which teeth extend through the apertures 5*b* into series of apertures 4*a* previously provided in the material along the edges, so that when the material 4 is driven for the treatment in a direction as shown in arrows B, the sprockets 6 are rotatively driven with their teeth driven by the material so that the endless shield tape is also driven in the same direction as the material in synchronism therewith. Thus the continuously feeding the hoop material performs local plating of the material with resulting increased treating rate. When it is desired to change figures and locations of the local plated portions, all that is required is a replacement of the shield tape with other one. If it is required to plate both sides of a material, a further shield tape may be provided on an opposite side of the material as shown in phantom lines in FIG. 4.

Figure 5A:
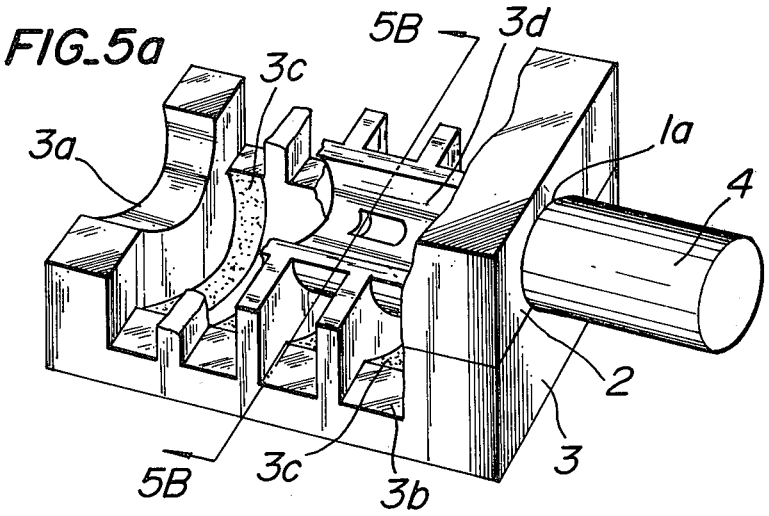
FIG. 5*a* is a perspective view of another embodiment partially removed and broken away of an apparatus according to the invention suitable for plating wires or rods.
Figure 5B:
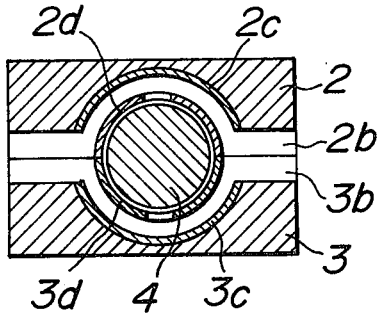
FIG. 5*b* is a sectional view of the apparatus taken along the line 5B—5B in FIG. 5*a;*

FIG. 5*a* is a partially removed perspective view and FIG. 5*b* is a sectional view taken along the line 5B—5B in FIG. 5*a* illustrating a unit suitable for plating rods or wires having a circular or polygonal section, wherein first and second unit halves are provided with semicylindrical cut portions 2*a* and 3*a*, respectively to form a cylindrical through passage 1*a* for feeding a rod or wire to be plated when the first and second unit halves are gathered together and passages 2*b* and 3*b* for treating liquid are formed with semicylindrical recesses within which are arranged electrodes 2*c* and 3*c*, radially inwardly of which are arranged semicylindrical or semicircular shield plates 2*d* and 3*d* adjacent to the rod to be plated. The unit shown in FIGS. 5*a* and 5*b* may be operated in the same manner as the unit for the hoop material as above described.

With the above arrangement according to the invention, a replacement of the treating unit or shield tape makes it possible to obtain various plated layers of desired sizes and shapes at desired locations on a material without requiring any skillful and troublesome operations in the prior art such as application of insulating tapes or coating with insulating paint and removal of them from the material after the treatment or plating. The unit according to the invention also makes it possible to pass materials to be treated through the unit while they are kept straight without requiring any rollers for bending the material in order to immerse it into a plating bath and any rollers for local plating, with the result that the apparatus according to the invention can be constructed in a small one as a whole, eliminating a risk of deformation or breakage of the material to be plated due to a tension owing to the rolls and enabling big or thick material which could not be bent by the rolls to be subjected to the treatment as plating. According to the invention by increasing flow velocity of the treating liquid in the unit the apparatus can perform the treatment such as plating at a high speed.

Figure 8:
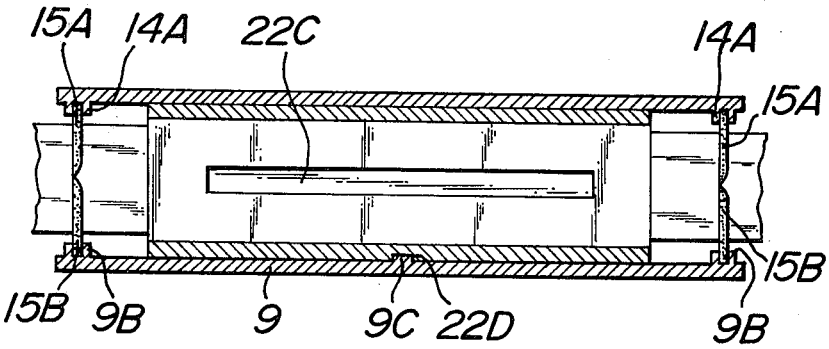
FIG. 8 is a sectional view taken along the line 8—8 in FIG. 6*a* after removal of the treatment unit.

FIGS. 6–10 show a preferred embodiment of a plating apparatus for hoop materials according to the invention. In FIG. 6*a* of a side view of the apparatus, a casing 7 consists of a bottom casing half 7A and a cover or an upper casing half 7B hinged therewith and formed with a rectangular slit 7B' for feeding the material into the treating unit. A stopper 7*c* controls the extremely opened position of the cover or upper casing half 7B. As shown in FIGS. 6*b* and 6*c*, the apparatus comprises a base 8 fixed to the underside of the bottom casing half 7A, a U-shaped unit fitting 9 fixed onto the base 8, whose lower arm is longer than the upper arm, which is wider than the length of the unit in the direction feeding the material and provided at the free end of the lower arm with a hook portion 9A of the unit supported by a holder which will be explained later, a treating liquid supply pipe 10 supplied with the liquid through a hose 12 and a joint 13 and fixed to the fittings including a rectangular injection opening 10A for the treating liquid and a mating surface 10B in contact with an injection opening 22*c* for the liquid of a holder 22 later described through a packing 11 having a injection opening the same in shape as the opening 22*c*, a hood 14 having the same width as the fitting 9 and pivotally connected to the upper portion of the fitting by means of hinges for introducing the liquid exhausted from passages into the bottom of the bottom casing 7A when the hood is in a closed position covering the treating unit, wipers 15A and 15B located at inlet and outlet for the material to be treated (FIG. 6*a*) for wiping away the residual liquid on the material after a pretreatment and a treatment to prevent the liquid from entering a next process and from flowing out of the casing, the wipers being mounted within fixtures 14A and 9B at the ends of upper and lower sides of the hood 14 and fitting 9 so as to be in contact with each other with their ends as shown in FIG. 8, a stopper 16 controlling the extremely opened position of the hood 14, a stopper 17 for suppressig the hood 14 when the cover 7B is closed, and an exhausting pipe 18 connected to a hose 19 for exhausting the liquid froma lower open end 14B of the hood 14 flowing down the oblique bottom of the bottom casing 7A, which liquid is then returned to the supply pipe 10 for circulation. The casing 7 including the above assembly is located on an oblique base 20 with the oblique bottom so that the treating unit is horizontal. A numeral 21 denotes a treating unit supported by a holder 22, which is illustrated in detail in FIGS. 9*a*, 9*b* and 9*c*.

Figure 9A:
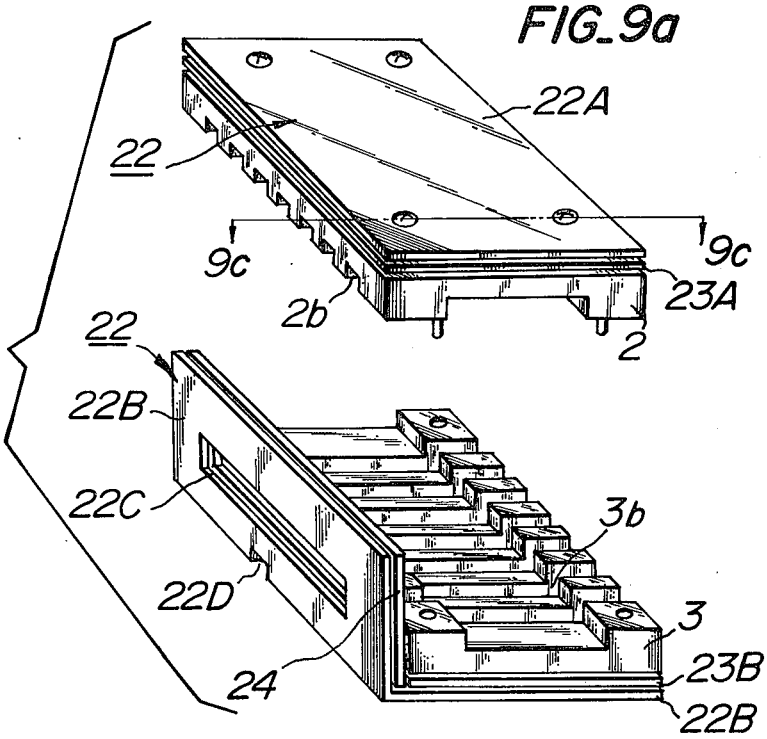
FIG. 9*a* is an exploded perspective view of the units secured to a holder used in the apparatus according to the invention.
Figure 9B:
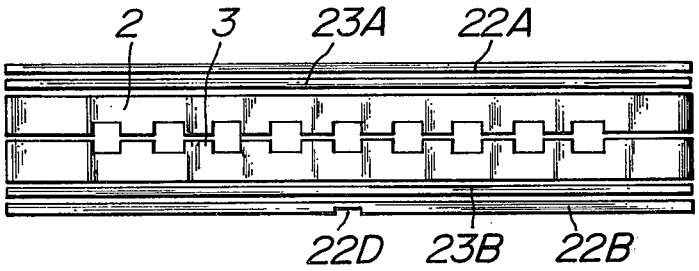
FIG. 9*b* is a front elevation of the units in FIG. 9*a;*
Figure 9C:
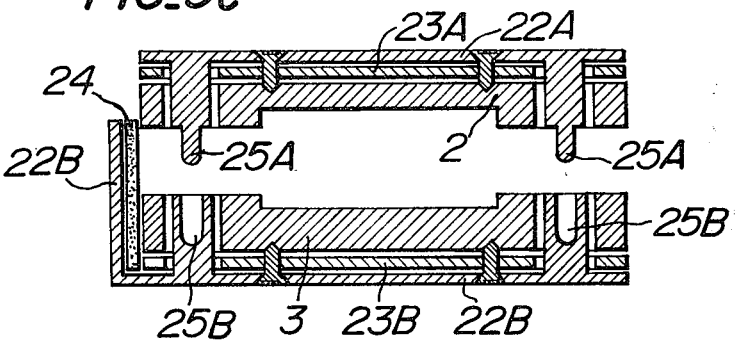
FIG. 9*c* is a sectional view taken along line 9C—9C in FIG. 9*a;*
Figure 10A:
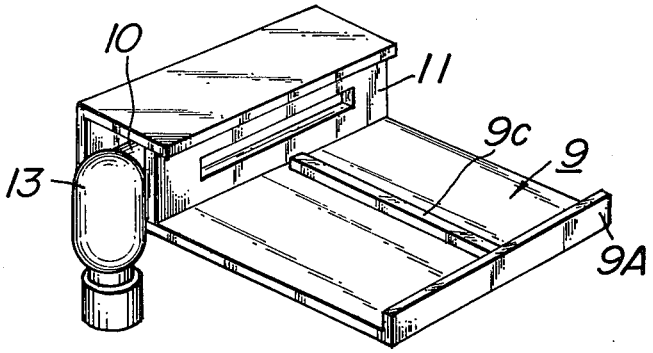
FIG. 10*a* is a perspective view of a fitting for the unit halves according to the invention.
Figure 10B:
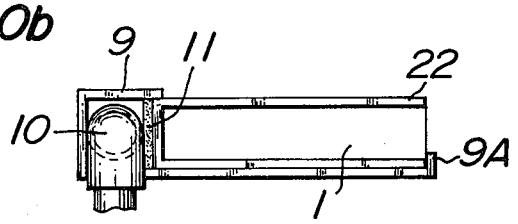
FIG. 10*b* is a side elevation of the fitting shown in FIG. 10*a* equipped with the holder.

Referring to FIGS. 9*a*, 9*b* and 9*c*, first and second unit halves 2 and 3 like those in FIG. 1 are provided with passages 2*b*, 3*b* and electrodes 2*c*, 3*c*, which are substantially the same in construction and operation as those in FIG. 2*c* so that the detailed construction and operation of the unit shown in FIG. 9 will not be explained. The holder 22 consists of an upper fixing plate 22A to which is fixed a first unit half 2 through an insulating plate 23A by means of setscrews and an L-shaped lower fixing plate 22B formed with an injection opening 22*c* for treating liquid, to which is fixed a second unit half 3 by means of setscrews through an insulating plate 23B and a packing 24 having an opening the same as the injection openings 22*c*. The upper and lower fixing plates 22A and 22B of the holder 22 are provided at their four corners with positioning protrusions and holes 25A and 25B as shown in FIG. 9*c*, and when the protrusions are inserted into the holes after the first and second unit halves 2 and 3 have been attached to the upper and lower fixing plates, respectively, the first and second unit halves are precisely in registry with each other to form passages 2*b*, 3*b* for treating liquid and an opening 2*a*, 3*a* for feeding materials to be plated. The lower fixing plate 22B is mounted on the fitting 9 in a manner such that a central ridge 9*c* of the fitting 9 as shown in FIG. 10*a* is received in an elongated recess 22D (FIG. 9*b*) formed in the underside of the lower fixing plate 22B in the same direction as the passages 3*b* for the treating liquid. The holder 22 with the unit 1 is thus held in place between the hook portion 9A and the supply pipe 10 through a packing 11. When the apparatus has thus been assembled, the injection opening 22*c* formed in the vertical plate of the L-shaped lower fixing plate 22B is in registry with the openings of the packing 11 and the supply pipe 10.

With the apparatus thus assembled, the treating liquid is forced from a tank (not shown) to the passages 2b and 3b through the hose 12, joint 13, supply pipe 10 and openings 10A, 22C and returned to the tank through the hood 14, oblique bottom of the bottom casing 7A and exhaust pipe 18. A hoop material 4 is inserted into the through passage 1a at the rectangular slit 7B' and driven by means of driving rollers (not shown) in contact with both sides of the material while voltage is applied between the electrodes 2c, 3c and the hoop material 4 so as to make current flow therebetween in order to plate the material 4.

Figure 11A:
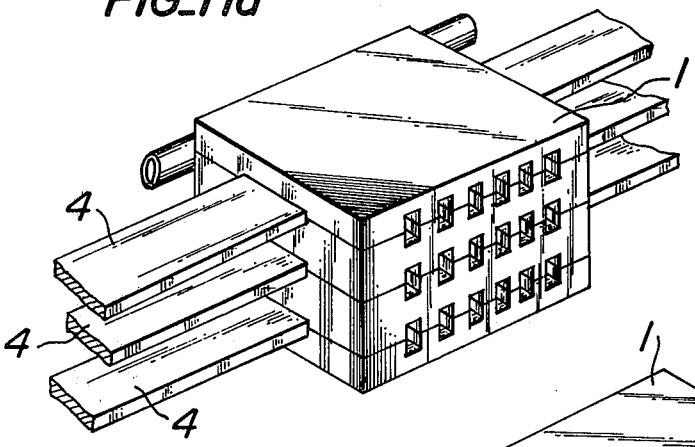
FIG. 11*a* is a perspective view of the apparatus comprising a plurality of units piled upon the other for treating a plurality of materials simultaneously according to the invention.
Figure 11B:
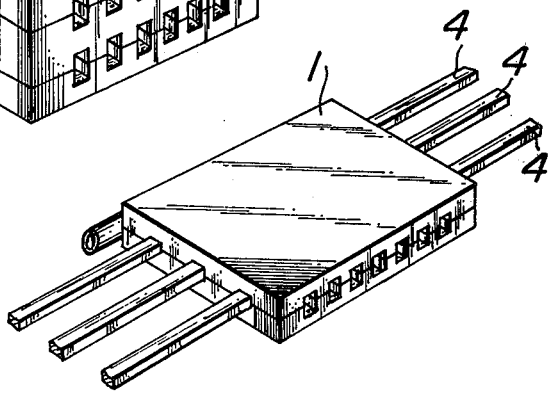
FIG. 11*b* is a perspective view of the apparatus capable of treating a plurality of material simultaneously.

As can be seen from the above description, the apparatus according to the invention can readily be enclosed by a cover as a whole to prevent the plating liquid from splashing about the space of a factory. Any noxious gases evaporating from the treating liquid can easily be exhausted out of doors by means of a ventilator connected to the casing, so that a workshop where plating is performed is always kept in a sanitary condition. Additionally, the apparatus comprises the treatment unit 1, which is able to be divided into two parts or unit halves, adapted to be detachably attached to the holder 22, which is also able to be divided into two parts, to form a unitary body which can be incorporated in the apparatus by simple insertion of the unitary body into the fitting 9. Accordingly various local plating on one or both surfaces can be accomplished by a simple replacement of a combination of unit halves 2 and 3. The unitary body consisting of the unit 1 and holder 22 forms a so-called cartridge which is adapted to be inserted into the fitting 9, which provides a great flexibility of the apparatus because only one apparatus can perform local plating on plate-like materials, rods, wires and others having any other various sections. The apparatus according to the invention performs plating on a material under a straight condition fed toward the passages for treating liquid of the small treatment unit, without using rolls acting upon a material to bent it into a plating bath as in the prior art. According to the invention, therefore, there is no risk of deformation or breakage of the material to be treated and the apparatus can be made small and light weight and inexpensive. Additionally, the apparatus according to the invention performs simultaneously plating of a plurality of material in parallel in common plating liquid in a small space by piling up a plurality of treatment units, in a casing as shown in FIGS. 11a and 11b or by passing a plurality of materials through the same treatment unit. The above advantages of the invention could never be obtained in the prior art.

Figure 12:
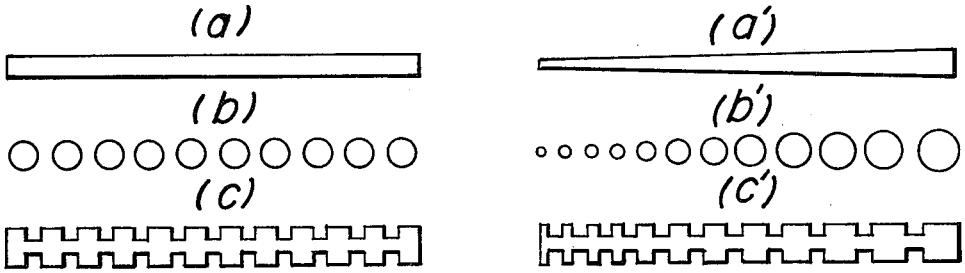
FIG. 12 shows various injection openings of the supply pipe used in the apparatus according to the invention.
Figure 13A:
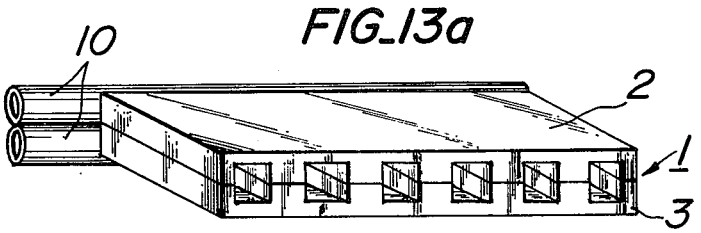
FIGS. 13*a* and 13*b* are perspective views showing the unit according to the invention equipped with a plurality of supply pipes.
Figure 13B:
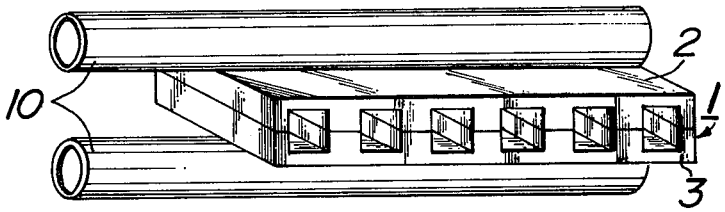

Although the injection openings 10A, 22C of the supply pipe 10 and the holder 22 in the above embodiments have been shown rectangular as shown in FIG. 12a, they may be circular or comb-like corresponding to passages for treating liquid as shown in FIG. 12b or FIG. 12c. In order to avoid a lack of uniformity in flow of the liquid in the passages caused by the difference between the upstream and downstream of the supply pipe 10, the height of the injection openings on the upstream side may be made less than that on the downstream side and tapered toward the downstream side as shown in FIGS. 12a', 12b' and 12c'. Although the supply pipe 10 has been shown as a single pipe, two or more supply pipe may be provided to increase the amount of supplied liquid as shown in FIG. 13a or arranged over and under the treatment unit 1 as shown in FIG. 13b. The direction of the supply pipe 10 and direction and number of the passages 2b, 3b for the treating liquid may be selected in any desired fashion.

Figure 14:
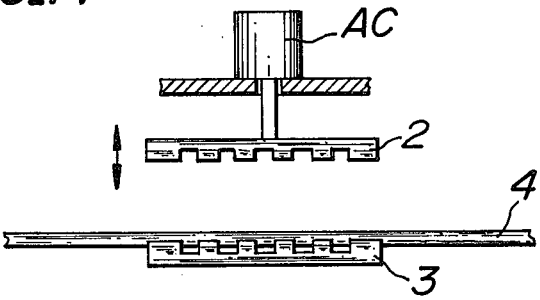
FIG. 14 is an explanatory view showing an arrangement of a material in the treatment unit according to the invention.

In the above description, the invention has been mainly described with reference to hoop materials to be plated, but any materials having a circular, polygonal or any other sectional area by the use of the treatment unit as shown in FIG. 5. It has been described in the above description that after the material has been embraced between the first and second unit halves, this assembly is mounted onto the fitting. However, after the second unit half secured to a fixing plate has been mounted onto a fitting, the material to be treated and the first unit half secured to a fixing plate may be applied to the second unit half. As shown in FIG. 14, the first unit half 2 may be raised by the use of a pneumatic cylinder AC or the like, and after the material 4 has been arranged on the second unit half 3, the first unit half 2 may be lowered onto the second unit 3.

As can be seen from the above description, the invention has remarkably significant effects in practical use and advantages in that the materials are subjected to electrolytic treatment in desired shapes and sizes and at desired locations on the material in rapid operation with ease.

It is understood by those skilled in the art that the foregoing description is a preferred embodiment of the disclosed device and that various changes and modifications may be made in the invention without departing from the spirit and scope thereof.

What is claimed is:

1. An apparatus for electrolytic treating elongated materials such as hoop materials, rods and wires comprising:

a casing having an opening for feeding the material to be treated;

a treatment unit consisting of first and second unit halves one upon the other and enclosed in said casing;

said unit halves including a through passage for feeding said material to be treated;

at least one insulating passage for flowing a treating liquid onto surfaces of said material to be treated as it is transferred through said through passage;

said insulating passage being made as a plurality of passages substantially perpendicular to said through passage and extending transversely across said material;

electrodes for causing electric current to flow between the electrodes and said material; and at least one insulating shield between said insulating passages and said material for shielding portions of said material from being treated.

2. An apparatus as set forth in claim 1, wherein said insulating passages and said electrodes are disposed on both sides of said material, said electrodes being parallel to said insulating passages and substantially perpendicular to said through passage and extending transversely across said material.

3. An apparatus as set forth in claim 1, wherein said material is a sheet of material, and said insulating passages are disposed on both sides of said sheet with said electrodes disposed in the bottoms of said insulating passages, and said insulating passages including insulating partitions between each insulating passage.

4. An apparatus as set forth in claim 1, wherein one ends of said passages of the unit halves for the liquid are communicated with each other over a certain length and the shields are cut away to an extent facing said communicated portions of said passages, within which are settled said electrodes.

5. An apparatus as set forth in claim 4, wherein said communicated portions of said passages are arranged at more than one location.

6. An apparatus as set forth in claim 1, wherein said shields are formed with at least one through apertures corresponding in configuration to a portion on the material to be treated.

7. An apparatus as set forth in claim 1, wherein said electrodes extend all over the passage for the liquid.

8. An apparatus as set forth in claim 1, wherein one of said unit halves is provided only with flat cut portion but devoid of the other portions, such as said electrodes and said passages for the liquid.

9. An apparatus as set forth in claim 1, wherein said passages for the liquid are varied in shape and width corresponding to portions on the material to be treated.

10. An apparatus as set forth in claim 1, wherein said insulating shield is formed in endless and is driven contact and in synchronism with said material.

11. An appartus as set forth in claim 10, wherein said endless shield is arranged on each side of the material.

12. An apparatus as set forth in claim 1, wherein said through passage for the material is formed in a shape corresponding to a section of a material to be treated such as rods and wires having a section such as circular, polygonal and the like, and said electrodes and shields are formed in configuration corresponding to that of the passage.

13. An apparatus as set forth in claim 1, the treatment unit is so constructed that a plurality of materials are fed to be treated simultaneously.

14. An apparatus as set forth in claim 13, a plurality of the treatment units are piled up, thereby enabling a plurality of materials to be treated simultaneously.

15. An apparatus as set forth in claim 13, wherein said treatment unit is provided with a plurality of through passages for feeding said plurality materials to be treated simultaneously.

16. An apparatus as set forth in claim 1, wherein there are provided with a plurality of supply pipes for supplying the treating liquid.

17. An apparatus as set forth in claim 16, wherein said supply pipes are provided over and under said treatment unit.

* * * * *

UNITED STATES PATENT OFFICE
CERTIFICATE OF CORRECTION

Patent No. 4,014,773 Dated March 29, 1977

Inventor(s) Kiyoto Furuya

It is certified that error appears in the above-identified patent and that said Letters Patent are hereby corrected as shown below:

Column 2, line 33, after "3e" insert -- 3e' --.

Column 2, line 57, "8-8" should read -- A-A --.

Column 4, line 60, "plates" should read -- plated --.

Column 6, line 27, "froma" should read -- from a --.

Column 9, line 24, delete "in" before "endless" and following "driven" insert -- in --.

Figure 6A:
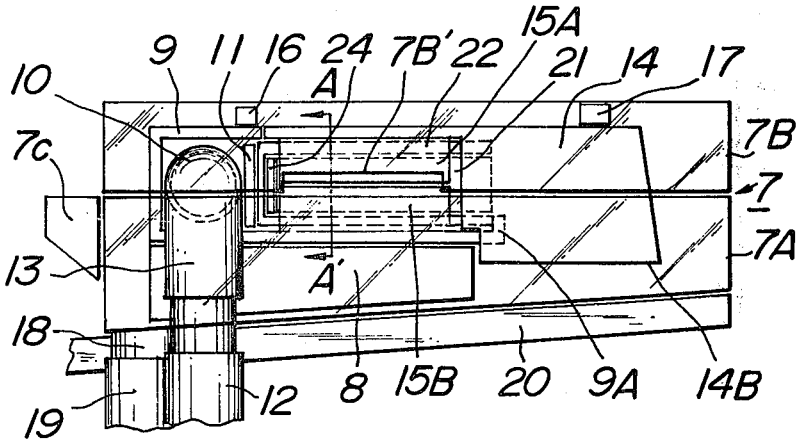
FIG. 6*a* is a side elevation of an apparatus showing the inside thereof according to the invention.
Figure 6B:
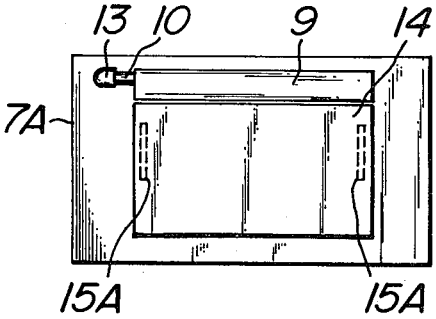
FIG. 6*b* is a plan view after removal of a casing of the apparatus shown in FIG. 6*a;*
Figure 6C:
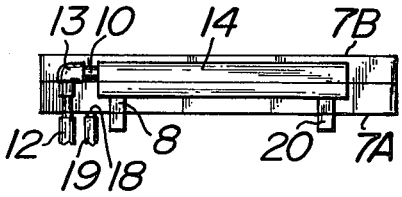
FIG. 6*c* is a front elevation of the apparatus as viewed in an arrow 6C in FIG. 6*a;*
Figure 7B:
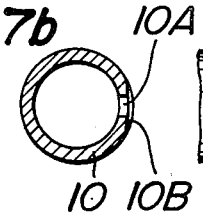
FIG. 7*b* is a sectional view of the supply pipe as shown in FIG. 7*a;*
Figure 7A:
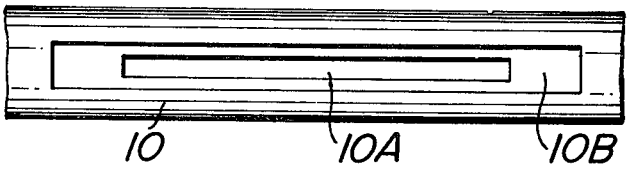
FIG. 7*a* is a front elevation of a supply pipe for a treating liquid used in the apparatus as shown in FIG. 6*a;*

Figure 6a should appear as shown on the attached sheet.

UNITED STATES PATENT OFFICE

CERTIFICATE OF CORRECTION

Patent No. 4,014,773 Dated March 29, 1977

Inventor(s) Kiyoto Furuya

It is certified that error appears in the above-identified patent and that said Letters Patent are hereby corrected as shown below:

FIG. 6a

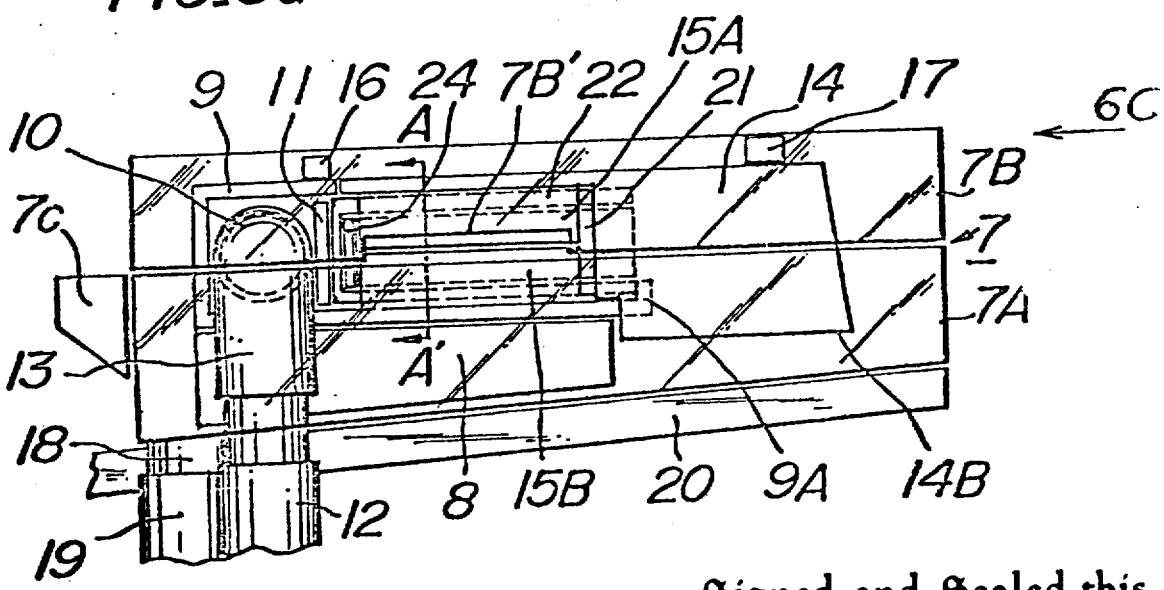

Signed and Sealed this

Fourth Day of October 1977

[SEAL]

Attest:

RUTH C. MASON
Attesting Officer

LUTRELLE F. PARKER
Acting Commissioner of Patents and Trademark